US006168781B1

(12) United States Patent
Ukaji et al.

(10) Patent No.: US 6,168,781 B1
(45) Date of Patent: Jan. 2, 2001

(54) SPRAYING APPARATUS FOR ARTIFICIAL HAIR AUGMENTING AGENT

(75) Inventors: Kazuo Ukaji, Tokyo; Mamoru Shibuya, Saitama, both of (JP)

(73) Assignees: Kao Corporation; Rhythm Watch Co., LTD, both of Tokyo (JP)

( * ) Notice: Under 35 U.S.C. 154(b), the term of this patent shall be extended for 0 days.

(21) Appl. No.: 09/147,265

(22) PCT Filed: Mar. 16, 1998

(86) PCT No.: PCT/JP98/01097

§ 371 Date: Nov. 16, 1998

§ 102(e) Date: Nov. 16, 1998

(87) PCT Pub. No.: WO98/41332

PCT Pub. Date: Sep. 24, 1998

(30) Foreign Application Priority Data

Mar. 17, 1997 (JP) ..... 9-062951

(51) Int. Cl.[7] ..... B05B 7/14

(52) U.S. Cl. ..... 424/70.11; 239/336; 239/346; 239/143

(58) Field of Search ..... 623/15; 424/70.11; 239/346, 336, 8, 9, 372, 373, 143; 366/105; 406/179, 159

(56) References Cited

U.S. PATENT DOCUMENTS 2,029,408 * 2/1936 Bramsen et al. ..... 239/654
2,717,804 * 9/1955 White ..... 239/373 X
2,993,652 * 7/1961 Curry ..... 239/372 X
3,054,210 * 9/1962 Kratzer et al. ..... 239/654
3,263,927 * 8/1966 Johnson ..... 239/373 X
3,722,818 * 3/1973 Hayasaki ..... 239/372 X
4,681,262 * 7/1987 Sprute ..... 239/346 X

FOREIGN PATENT DOCUMENTS 48-40036 * 11/1973 (JP) .
61-183152 * 11/1986 (JP) .
6-26684 * 4/1994 (JP) .
6-142562 * 5/1994 (JP) .
8-168704 * 7/1996 (JP) .
8-173862 * 7/1996 (JP) .
9-29144 * 2/1997 (JP) .

* cited by examiner

*Primary Examiner*—Kevin Weldon
(74) *Attorney, Agent, or Firm*—Oblon, Spivak, McClelland, Maier & Neustadt, P.C.

(57) ABSTRACT

An apparatus for spraying pseudo hair increasing material including a first container 3 for storing therein pseudo hair increasing material 2, and a second container 4 detachably coupled to the first container 3 through a coupler 30, the second container 4 being provided therein with an injection mechanism 9 for injecting the propellant gas into the first container 3 through an injection nozzle 5, the first container 3 being formed with a discharge port 31 for discharging the pseudo hair increasing material therethrough, the discharge port 31 having an axis in alignment with that of the injection nozzle 5, a bore of the discharge port 31 being larger than that of an injection port 50 formed on a distal end of the injection nozzle 5, through operation of the injection mechanism 9, the propellant gas from the injection nozzle 5 being injected to thereby cause the pseudo hair increasing material to be discharged from the discharge port 31 towards a predetermined area.

5 Claims, 5 Drawing Sheets

SPRAYING APPARATUS FOR ARTIFICIAL HAIR AUGMENTING AGENT

This application is the national stage of International Application No. PCT/JP98/01097, filed Mar. 16, 1998.

TECHNICAL FIELD

This invention relates to an apparatus for spraying pseudo hair increasing material (or adding material, or thickening material) suited to be used for supplementing a locally hair-decreased area of the head of a person who needs more hair.

BACKGROUND ART

As well known, there is generally practiced, as related art, a method (apparatus) for temporarily supplementing a locally hair-decreased area of a person's head, as disclosed, for example, in Japanese Patent Examined Publication (Kokoku) No. Sho 48-40036. According to this method, pseudo hair increasing material is applied to a locally hair-decreased area of a person's head through a reticular aperture (or mesh aperture) formed in a container and then, combed or brushed so that the material will come to be intimate with the natural hair. However, the above method (apparatus) cannot obtain the user's satisfaction in respect of effects and easiness of use because the amount of discharged pseudo hair increasing material tends to be irregular and difficult to be sprayed towards the targeted hair-decreased area.

Also, a method (apparatus) as disclosed by Japanese Patent Examined Publication (Kokoku) No. Hei 6-26684 is proposed. According to this method (apparatus), propellant gas is injected directly to pseudo hair increasing material to cause the pseudo hair increasing material to be dispersed under the effect of its injection pressure so that the pseudo hair increasing material will be applied to a hair-decreasing area, and then, the natural hair at the hair-decreasing area with the pseudo hair increasing material applied thereto is combed or brushed so that the pseudo hair increasing material will come to be intimate with the natural hair.

In the above method (apparatus), however, since propellant gas is injected directly to the pseudo hair increasing material to cause the pseudo hair increasing material to be dispersed under the effect of its injection pressure, a discharge amount of the pseudo hair increasing material varies greatly depending on the largeness of the space where the pseudo hair increasing material is dispersed. When liquid gas is used as the propellant gas, the gas is cooled by its evaporation heat and as a result, the pseudo hair increasing material is deposited with frost, thus sometimes resulting in insufficient dispersion of the pseudo hair increasing material. Moreover, this apparatus is incapable of injecting the liquid composition simultaneously.

An apparatus for discharging fine fabric material such as collagen fine fabric, although this is not an apparatus for spraying pseudo hair increasing material, is disclosed by Japanese Patent Unexamined Publication (Kokai) No. Hei 6-142562. In this apparatus, gas is injected into a container in which collagen fine fabrics are stored, so that a jet stream is generated in the container. Then, under the effect of minus pressure caused by the jet stream, the fine fabric material is taken into the jet stream and injected outside together with the jet stream. However, since the container portion in this apparatus comprises a body and a closure portion detachably attached to the body, there is a fear that gas will leak from the engagement portion and that the discharge amount will become irregular due to suction of external air. When the fine fabric material is used up, additional fine fabric material must be supplemented. At that time, however, it is unavoidable that the peripheral area and hand are soiled by the fine fabric material, etc. remained in the container portion, when the additional fine fabric material is supplemented.

DISCLOSURE OF INVENTION

It is, therefore, a first object of the present invention to provide an apparatus for spraying pseudo hair increasing material, in which pseudo hair increasing material in the form of powder or short fabrics can be sprayed to an area of a person's head where hair is locally decreased, continuously and in a stable manner, and pseudo hair increasing material or propellant gas can easily be supplemented without soiling the peripheral area and hand, simply by replacing the container containing pseudo hair increasing material or the container containing propellant gas.

A second object of the present invention is to provide an apparatus for spraying pseudo hair increasing material, in which pseudo hair increasing material in the form of powder or short fabrics can be sprayed to an area of a person's head where hair is locally decreased, continuously and in a stable manner, and an attachment force for attaching the pseudo hair increasing material thus sprayed, to the natural hair and the scalp of a person's head can be increased.

According to the feature of the present invention as recited in claim 1, the first object can be achieved by providing an apparatus for spraying pseudo hair increasing material including a first container for storing therein pseudo hair increasing material in a form of powder or short fibers, and a second container for storing therein propellant gas, the first and second containers being detachably coupled to each other through a coupler, the second container being provided therein with an injection mechanism for injecting the propellant gas into the first container through an injection nozzle, the first container being formed with a discharge port for discharging the pseudo hair increasing material therethrough, the discharge port having an axis in alignment with that of the injection nozzle, a bore of the discharge port being larger than that of an injection port formed on a distal end of the injection nozzle, through operation of the injection mechanism, the propellant gas from the injection nozzle being injected to thereby cause the pseudo hair increasing material to be discharged from the discharge port towards a predetermined area.

According to the feature of the present invention as recited in claim 4, the second object is achieved by providing an apparatus for spraying pseudo hair increasing material including a first container for storing therein pseudo hair increasing material in a form of powder or short fabrics, a second container for storing therein a first propellant gas, a third container for storing therein a liquid composition for fixing pseudo hair and a second propellant gas, and an injection mechanism for injecting the first propellant gas into the first container through an injection nozzle and for injecting the hair fixing liquid composition towards a predetermined area by the second propellant gas, the first container being formed with a discharge port for discharging the pseudo hair increasing material therethrough, the discharge port having an axis in alignment with that of the injection nozzle, a bore of the discharge port being larger than that of an injection port formed on a distal end of the injection nozzle, through operation of the injection mechanism, the hair fixing liquid composition being injected towards a predetermined area and the pseudo hair increasing material being discharged towards the predetermined area by the first propellant gas injected from the injection nozzle, through the discharge port.

BEST MODE FOR CARRYING OUT THE INVENTION

Figure 1A:
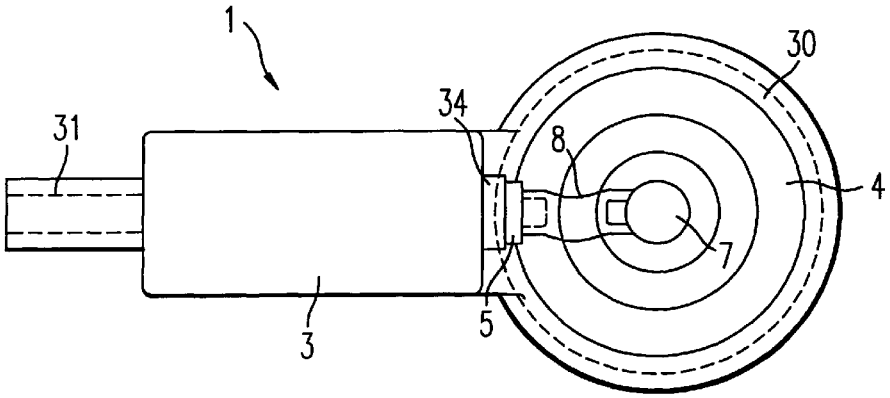
FIG. 1 shows a first embodiment of an apparatus for spraying pseudo hair increasing material according to the present invention, FIG. 1(*a*) is a plan view and FIG. 1(*b*) is a side sectional view.
Figure 1B:
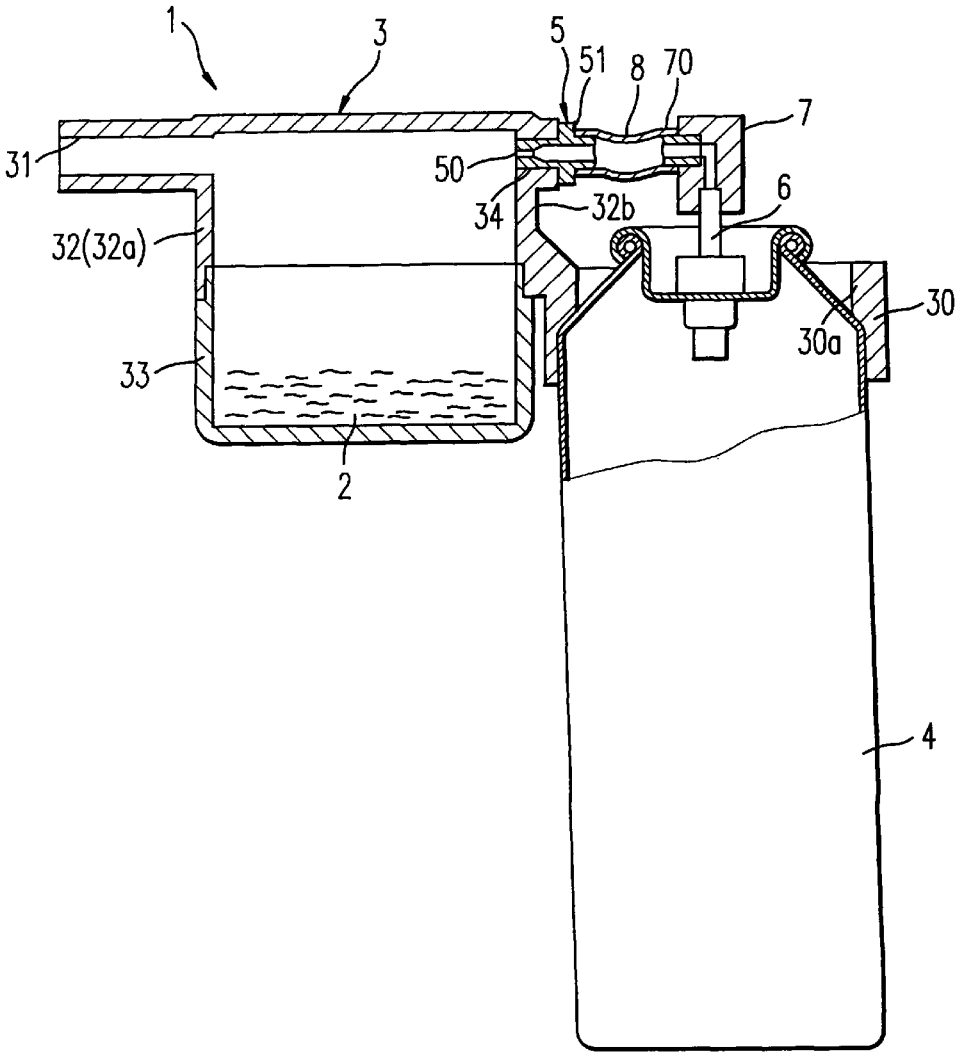
Figure 2:
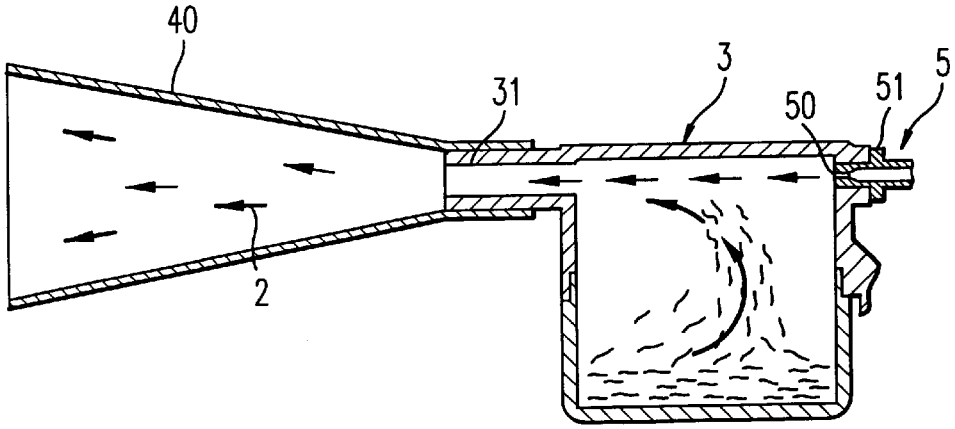
FIG. 2 is a schematic view showing a spraying state in the spraying apparatus of FIG. 1.

Specific embodiments incorporated with the present invention will be described hereinafter with reference to the drawings. Here, FIGS. 1 and 2 are views showing an apparatus for spraying pseudo hair increasing material according to the present embodiment (first embodiment), FIG. 1(*a*) is a plan view, FIG. 1(*b*) is a side sectional view, and FIG. 2 is a schematic view showing a state of use. In the illustration, reference numeral 1 denotes an apparatus for spraying pseudo hair increasing material (hereinafter referred to the "spraying apparatus").

As shown in FIG. 1, the spraying apparatus 1 according to the first embodiment of the present invention includes a first container 3 for storing therein pseudo hair increasing material 2 in a form of powder or short fabrics, and a second container 4 for storing therein propellant gas, the first and second containers 3 and 4 being detachably coupled to each other through a coupler 30 coupled to the first container 3.

The second container 4 is provided therein with an injection mechanism for injecting the propellant gas into the first container 3 through an injection nozzle 5, the first container 3 being formed with a discharge port 31 for discharging the pseudo hair increasing material 2 therethrough, the discharge port 31 having an axis in alignment with that of the injection nozzle 5, a bore of the discharge port 31 being larger than that of an injection port 50 formed on a distal end of the injection nozzle 50, through operation of the injection mechanism, the propellant gas from the injection nozzle 5 being injected to thereby cause the pseudo hair increasing material 2 to be discharged from the discharge port 31 towards a predetermined area.

The spraying apparatus 1 according to the first embodiment will now be described in detail.

As shown in FIG. 1, the spraying apparatus 1 according to this embodiment generally includes the first container 3 for storing therein the pseudo hair increasing material 2 in the form of powder or short fabrics, and the cylindrical second container 4 for filling therein the propellant gas, the first and second containers 3 and 4 being detachably coupled to each other through the coupler 30 coupled to the first container 3.

The first container 3 comprises a first member 32 exhibiting a generally rectangular configuration in top sectional view and having an upper wall portion defined by an arcuate curved surface, and a second member 33 formed of a box-like member having a bottom which exhibits a generally rectangular configuration in top sectional view and unremovably bonded to the first member 32.

An annular coupler 30 engagingly locked to an upper part of the second container 4 is continuous with a rear surface portion 32*b* of the first member 32. The coupler 30 is formed by integral molding together with the first container 3. In the alternative, the coupler 30 is separately molded and then coupled to the first container 3 by welding or the like.

As shown in FIG. 1, the coupler 30 is an annular member which is formed on an upper portion thereof with an annular stopper 30*a* projecting inwardly and whose inside diameter is generally equal to the outside diameter of the second container 4. The coupler 30 is engagingly locked to upper part of the second container 4.

The first container 3 and the second container 4 can easily be separated from each other by pulling up the coupler 30 which is engagingly locked to the upper part of the second container 4 after a joint tube 8 of an injection mechanism, as later described, is detached from the injection nozzle 5.

The first container 3 has an attachment port 34 for the injection nozzle 5 formed in an upper center of the rear surface portion 32*b* and a discharge port 31 for the pseudo hair increasing material 2 formed in an upper center of a front surface portion 32*a* confronting the attachment port 34. The discharge port 31 is circular in section and same in inside diameter at its opposite ends. The inside diameter of the discharge port 31 at its end on the side of the interior of the container 3 is larger than the inside diameter of the injection port 50 of the injection nozzle 5 firmly fitted into the attachment port 34 on the side of the interior of the container 3. The attachment port 34 has a circular configuration in section and is formed in such a location that the axis of the injection port 50 of the injection nozzle 5 firmly fitted is in alignment with that of the discharge port 31.

The bore of the discharge port for the pseudo hair increasing material and the bore of the injection port at a distal end of the injection nozzle in the present invention refer to the inside diameters, respectively, at the end portion on the side of the first container. In the spraying apparatus for pseudo hair increasing material of this embodiment, the bore $R_1$ of the discharge port, the bore $R_2$ of the injection port at the distal end of the injection nozzle 5, the bore ratio ($R_1/R_2$) and the distance L between the discharge port and the injection port and the [preferred values] thereof are as follows. In each item listed below, the numerical value listed first shows the numerical value of each portion in this embodiment.

Discharge port bore $R_1$: 4 mm diameter [3 to 10 mm, particularly, 4 to 7 mm]

Injection port bore $R_2$: 0.5 mm diameter; [0.2 to 1.0 mm, particularly, 0.4 to 0.8 mm]

Bore ratio ($R_1/R_2$): 8 [3 to 50, particularly, 5 to 15]

Distance L between discharge port and injection port: (see FIG. 5) 44 mm [30 to 60 mm, particularly, 34 to 54 mm]

The second container 4 is chiefly fabricated of a conventional well-known aerosol container capable of injecting the propellant gas filled therein by pushing down the nozzle member 6 disposed on an upper end portion thereof through a spring. Fitted to an upper end portion of the nozzle member 6 is a button 7 having therein a vertical conduit and a horizontal conduit communicated with each other and adapted to introduce the propellant gas into the first container 3. The injection nozzle 5, which is disposed on an upper portion within the first container 3 such that the propellant gas can be injected in a horizontal direction, is attached to a distal end portion of a horizontal tube portion 70 of the button 7 through a flexible joint tube 8. Here, the nozzle member 6, the button 7 and the joint tube 8 constitute the injection mechanism.

The injection nozzle 5 is a hollow tubular member made of metal. The injection nozzle 5 has the injection port 50 formed on a distal end portion thereof and having the inside diameter smaller than the remaining portion. An annular projection 51 projecting in a circumferential direction is formed on the injection nozzle 5 at a location a little to its rear end portion from its axial center. The injection nozzle 5 is fixed with its area from the distal end portion where the injection port 50 is formed to the annular projection 51 fitted to the attachment port 34 of the first container 3. The joint tube 8 made of flexible rubber is connected to the injection nozzle 5 at its area offset to its rear end side from the annular projection 51. Through this joint tube 8, the injection nozzle 5 and the injection mechanism can be separated from each other and connected together. Specifically, the injection nozzle 5 is formed on a connecting area of the joint tube 8 with three annular detachment-preventive projections (not shown) projecting in an outer peripheral direction, such that the joint tube 8 will not be detached merely by increase of the internal pressure of the joint tube 8 when in use or the like. However, the joint tube 8 can easily be pulled out of the injection nozzle 5 by hand.

One example of a way of use of the apparatus for spraying pseudo hair increasing material according to the first embodiment will now be described. First, the pseudo hair increasing material 2 in the form of powder or short fabrics is stored in the first container 3 and the propellant gas is filled or stored in the second container 4.

Then, with the aerosol container 4 held with hand, the discharge port 31 is pointed to the area of the head where the pseudo hair-increase material is needed while confirming through a mirror or the like and actuated by operating the injection mechanism disposed at the second container 4.

Specifically, the button 7 is pushed downward. When the pushing pressure pushes the button 7 downward, the nozzle member 6 is simultaneously pushed downward. As a result, the propellant gas stored or filled in the second container 4 is injected into the first container 3 via the nozzle member 6, the button 7, the joint tube 8 and the injection nozzle 5.

The propellant gas injected into the first container proceeds straight towards the discharge port 31 and injected outside through the discharge port 31 as shown in FIG. 2. The sectional area of the gas jet stream injected from the injection nozzle 5 is somewhat increased at the area for the gas jet stream to enter the interior of the discharge port 31 compared with at the area where the gas jet stream passes immediately after it is injected from the injection port 50. However, since the bore of the discharge port 31 is larger than that of the injection port 50, the gas jet stream never circulates within the first container 3. By this gas jet stream, negative pressure is generated within the first container 3 and the gas contacting an outer peripheral portion of this velocity within the container 3 is dragged and begins to move to thereby generate a swirl or vortical flow within the first container 3.

The pseudo hair increasing material 2 is circulated within the first container 3 carried by the vortical flow. Accordingly, there is no fear that the pseudo hair increasing material is frosted unlike the case where the propellant gas is injected directly to the pseudo hair increasing material 2. Moreover, the pseudo hair increasing material is never formed into a mass by being mutually tangled or press fitted under compression.

The pseudo hair increasing material coming close to this jet stream is drawn into the jet stream by the negative pressure and injected from the discharge port 31 so as to be sprayed to a desired area of the head such as the area where hair is locally decreased.

According to the spraying apparatus 1 of this embodiment, merely by pushing down the injection button 7, the pseudo hair increasing material in the form of powder or short fabrics can easily be sprayed to the area of the head where hair is decreased, continuously and in a stable manner.

Moreover, when the pseudo hair increasing material is circulated within the first container 3 carried by the vortical flow, the individual pseudo hair increasing material are vigorously contacted with each other within the container and a static current generated by the contacting friction is charged to the pseudo hair increasing material. Accordingly, the sprayed pseudo hair increasing material is favorably adhered to the natural hair or the scalp of a person's head under the effect of the static current. Thus, according to the spraying apparatus 1 of this embodiment, merely by pushing down the injection button 7, the pseudo hair increasing material can be sprayed to the area of the head where hair is decreased, continuously and in a stable manner and the pseudo hair increasing material thus sprayed has a sufficient adhesive force with respect to the natural hair or the scalp of a person's head. Reference numeral 40 of FIG. 2 denotes a wrapper tube serves to keep more than a predetermined distance between the discharge port 31 and the head, so that the sprayed pseudo hair increasing material will be normally in a good condition and in addition, to prevent the pseudo hair increasing material from dispersing outside the head, so that the pseudo hair increasing material will be more correctly sprayed to the targeted area.

Furthermore, according to the spraying apparatus of this embodiment, since the first and second containers are detachably attached to each other through the coupler, the first container can easily be replaced with a new container or a container containing the pseudo hair increasing material of a desired color in case the pseudo hair increasing material stored in the first container 3 is used up or the selected color of the pseudo hair increasing material is not in match with the own hair of the person who needs more hair. Accordingly, even in case the pseudo-hair increasing material becomes short while the spraying operation is undergoing, the spraying operation can be immediately started again by replacing the container. It is also possible to replace the container with other containers containing the pseudo hair increasing material of different colors so that a container containing the pseudo hair increasing material of a color most suited to the person's own hair color can be selected for use. Also, when the replacement is made, the periphery and hand are not soiled by the pseudo hair increasing material.

Likewise, when the propellant gas in the aerosol container 4 as the second container is used up, the aerosol container 4 can easily be replaced with a new aerosol container 4'. Accordingly, the propellant gas can be supplemented quite easily and the pseudo hair increasing material remained in the first container can effectively completely be used without any waste.

Figure 3:
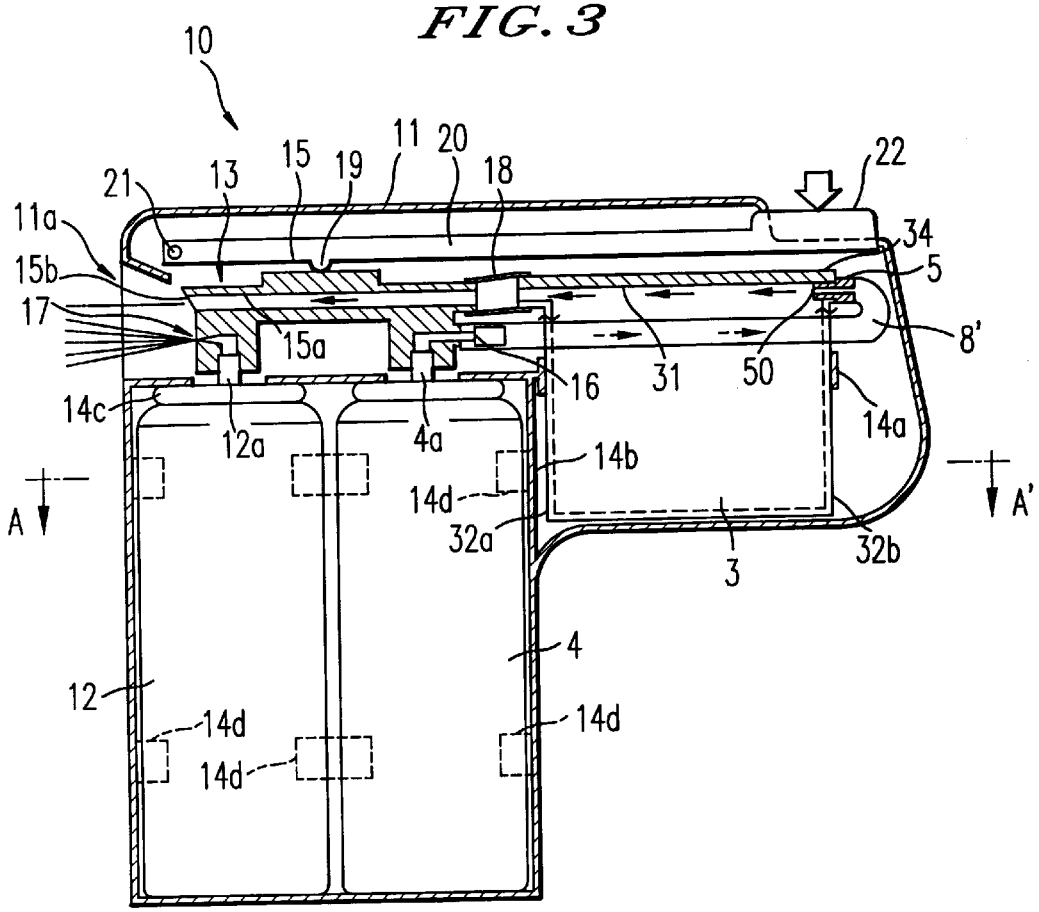
FIG. 3 is a side sectional view showing a second embodiment of the apparatus for spraying pseudo hair increasing material according to the present invention.
Figure 4:
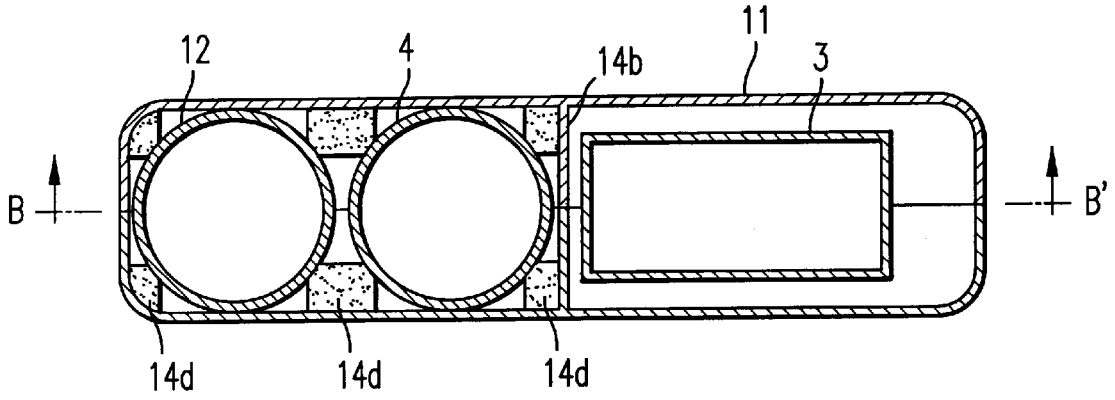
FIG. 4 is a sectional view taken on line A—A' of the spraying apparatus of FIG. 3.

FIGS. 3 and 4 are views showing a second embodiment of a pseudo hair increasing material according to the present invention, FIG. 3 is a side sectional view, and FIG. 4 is a sectional view taken on line A—A' of FIG. 3. In the illustration, reference numeral 10 denotes a spraying apparatus for pseudo hair increasing material (hereinafter referred to as the "spraying apparatus").

As shown in FIG. 3, the spraying apparatus 10 according to the second embodiment of the present invention generally includes, in a case 11 having a bottom, a pseudo hair increasing material storage container 3 (first container) for storing therein pseudo hair increasing material in a form of powder or short fabrics, an aerosol container 4 (second container) for storing therein a first propellant gas, an aerosol container 12 (third container) for storing therein a liquid composition for fixing pseudo hair and a second propellant gas, and an injection mechanism 13 for injecting the first propellant gas into the pseudo hair increasing material storage container 3 through an injection nozzle 5 and for injecting the hair fixing liquid composition towards a predetermined area by the second propellant gas. The pseudo hair increasing material storage container 3 and the injection nozzle 5 according to this embodiment are the same in construction as the first container and the injection nozzle 5 according to the first embodiment. The pseudo hair increasing storage container 3 is formed with a discharge port 31 for discharging the pseudo hair increasing material 2 therethrough, the discharge port 31 having an axis in alignment with that of the injection nozzle 5, a bore of the discharge port 31 being larger than that of an injection port 50 formed on a distal end of the injection nozzle 5. The bore of the discharge port 31, the bore of the injection port 50 at the distal end of the injection nozzle 5, the distance L therebetween, the range of preferred numerical values, etc. are also the same as those in the above embodiment.

In the spraying apparatus for pseudo hair increasing material according to this embodiment, through operation of the injection mechanism 13, the hair fixing liquid composition is injected towards a predetermined area and the pseudo hair increasing material 2 is discharged towards the predetermined area by the first propellant gas injected from the injection nozzle 5, through the discharge port 31.

The case 11 is of a construction dividable along a B—B' plane as shown in FIG. 4. Within the dividable case 11, the pseudo hair increasing material 3, the aerosol container 4 and the aerosol container 12 are independently detachably stored. Formed within the case 11 are fixing wall portions 14*a*, 14*b*, and 14*c* for fixedly holding the aerosol containers 4 and 12 in the case 11. Moreover, fixing members 14*d* are disposed at predetermined locations within the case 11.

The fixing wall portion 14*c* is formed with insertion holes generally coaxial with the aerosol containers 4 and 12 when the aerosol containers 4 and 12 are arranged and penetrable through leg portions of the injection button 15 as later described. When the aerosols containers 4 and 12 are arranged, their nozzle members 4*a*, 12*a* are projected upward from the insertion holes.

The aerosol container 4 is chiefly fabricated of a conventional well-known aerosol container capable of injecting the propellant gas filled therein by pushing down the nozzle member 4*a* disposed on an upper end portion thereof through a spring. The other aerosol container 12 is chiefly fabricated of a conventional well-known aerosol container capable of injecting the propellant gas and the hair fixing liquid composition filled therein by pushing down the nozzle member 12*a* disposed on an upper end portion thereof through a spring.

The nozzle member 4*a* of the aerosol container 4 and the nozzle member 12*a* of the aerosol container 12 are fitted with the injection button 15. By pushing down the injection button 15, the two legs of the injection button 15 simultaneously push down the nozzle members 4*a* and 12*a*.

The injection button 15 is formed with the injection port 16 for injecting the first propellant gas stored in the aerosol container 4 and the injection port 17 for injecting the second propellant gas and the hair fixing liquid composition in the aerosol container 12, such that the propellant gas or the propellant gas and the hair fixing liquid composition are injected in opposite directions. Above the injection ports 16 and 17, an injection conduit 15*a* for introducing the pseudo hair increasing material, which is discharged from the discharge port 31 of the pseudo hair increasing storage container 3 by the first propellant gas, outside is generally horizontally formed in the injection button 15.

The injection port 16 is fitted with a flexible joint tube 8' made of rubber. The other end of the joint tube 8' is connected to the injection nozzle 5 fixedly attached to the attachment port for the pseudo hair increasing material storage container 3. The first propellant gas injected from the injection port 16 is injected into the pseudo hair increasing material storage container 3 from the injection port 50 at the distal end of the injection nozzle 5 through the joint tube 8'.

The feature that an attachment port 34 for fixedly attaching the injection nozzle 5 is formed in an upper center of the rear surface portion 32*b* of the pseudo hair increasing material storage container 3, the construction and the manner of attachment of the injection nozzle 5 are the same as in the first embodiment.

A discharge port 31 for the pseudo hair increasing material 2 is formed in an upper center of a front surface portion 32*a* confronting the rear surface portion 32*b* where the attachment port 34 is formed, in the pseudo hair increasing material storage container 3. The discharge port 31 is circular in section and the inside diameter of the discharge port 31 is the same at opposite ends thereof. The discharge port 31 has an axis in alignment with the axis of the injection nozzle 5 and also a bore larger than the bore of the injection port 50 at the distal end of the injection nozzle 5.

The discharge port 31 is communicated with the discharge conduit 15*a* of the injection button 15 through a flexible horizontal tubular member 18 (made of rubber). The pseudo hair increasing material and the first propellant gas discharged from the discharge port 31 are passed through the horizontal tubular member 18 and the discharge conduit 15*a* and discharged from a discharge opening portion 15*b* at the other end.

An opening portion 11*a* is formed in a front surface of the case 11 where the discharge opening portion 15*b* and the injection port 17 for injecting the second propellant gas and the hair-fixing liquid composition are open. The first propellant gas, the pseudo hair increasing material, the second propellant gas and the hair fixing liquid composition are injected towards a predetermined area from the opening portion 11*a* in their admixed condition.

A lever type switch lever 20 is disposed on an upper portion of the injection button 15 with the projection 19 in abutment with the upper end portion of the injection button 15.

The lever type switch lever 20 is fixed at one end thereof by a pin 21 formed on the case 11, so that the other end portion can be moved upward and downward about the one end. The other end portion is normally biased upward under the effect of the spring for biasing the nozzle members 4*a*, 12*a* upward. A pressing portion 22 is formed on an upper surface of the other end portion. When the pressing portion 22 is pressed downward by finger, the projection 19 presses the upper end portion of the injection button 15 under the principles of a lever. That is, the pin 21 and the projection 19 function as a fulcrum and a point of application. Here, the nozzle member 4*a* of the aerosol container 4, the nozzle member 12*a* of the aerosol container 12, the injection button 15 and the lever type switch lever 20 constitute the injection mechanism 13.

In operation of the spraying apparatus 10 according to this embodiment, the pseudo hair increasing material in the form of powder or short fabrics is filled or stored in the pseudo-hair increasing material storage container 3 as the first container, the first propellant gas, in the aerosol container 4 as the second container, and the hair fixingliquid composition and the second propellant gas, in the aerosol container 12 as the third container, respectively and then the injection mechanism is actuated.

Specifically, with the case 11 held with hand, the opening portion 11*a* disposed at the front surface of the case 11 is pointed to the area of the head where the pseudo hair-increase material is needed while confirming through a mirror or the like and the pressing portion 22 of the lever type switch lever 20 is pushed down. When the pressing portion 22 is pushed down, the projection 19 is lowered about the pin 21 to push down the injection button 15. Then, by the injection button 15, the nozzle members 4*a* and 12*a* of the aerosol containers 4 and 12 are pushed down and the first propellant gas is injected from the injection port 16 and the second propellant gas is injected from the injection port 17 together with the hair fixing liquid composition.

The first propellant gas injected from the injection port 16 is injected into the pseudo hair increasing material storage container 3 via the joint tube 8' and the injection nozzle 5.

When the first propellant gas is injected into the pseudo hair increasing material storage container 3, the gas proceeds straight within the container 3 and is then flowed into the discharge port 31.

The sectional area of the gas jet stream injected from the injection nozzle 5 is somewhat increased at the area for the gas jet stream to enter the interior of the discharge port 31 compared with at the area where the gas jet stream passes immediately after it is injected from the injection port 50. However, since the bore of the discharge port 31 is larger than that of the injection port 50, the gas jet stream never circulates within the pseudo hair increasing material storage container 3. By this gas jet stream, negative pressure is generated within the first container 3 and the gas contacting an outer peripheral portion of this velocity within the container 3 is dragged and begins to move to thereby generate a swirl or vortical flow within the first container 3.

The pseudo hair increasing material is circulated within the container 3 carried by the vortical flow. Accordingly, there is no fear that the pseudo hair increasing material is frosted unlike the case where the propellant gas is injected directly to the pseudo hair increasing material. Moreover, the pseudo hair increasing material is never formed into a mass by being mutually tangled or press fitted under compression.

The pseudo hair increasing material coming close to this jet stream is drawn into the jet stream by the negative pressure and introduced into the discharge port 31. The pseudo hair increasing material thus introduced into the discharge port 31 is passed through the horizontal conduit 18 and the discharge conduit 15*a* and then injected from the discharge opening 15*b* so as to be sprayed to the area where hair is locally decreased.

When the pseudo hair increasing material is circulated within the container carried by the vortical flow, the individual pseudo hair increasing material are vigorously contacted with each other within the container and a static current generated by the contacting friction is charged to the pseudo hair increasing material. Accordingly, the sprayed pseudo hair increasing material is favorably adhered to the natural hair or the scalp of a person's head under the effect of the static current.

The second propellant gas and the hair fixing liquid composition injected from the injection port 17 are also likewise sprayed to the area of the head where hair is locally decreased. Since the hair fixing liquid composition is sprayed simultaneous with the pseudo hair increasing material, the pseudo hair increasing material is positively adhered to the natural hair or the scalp of the head by the adhesive force attributable to the hair fixing liquid composition in addition to the adhesive force attributable to the charging of the static current.

In this way, according to the spraying apparatus 10 of this embodiment, merely by pushing down the pressing portion 22 of the lever type switch lever 20, the pseudo hair increasing material can be sprayed to the area of the head where hair is locally decreased, together with the hair fixing liquid composition.

In the spraying apparatus 10 according to this embodiment, the injection opening portion 15*b* and the injection port 17 for the pseudo hair increasing material are formed in such a manner as to be oriented in the same direction and formed such that the hair fixing liquid composition can be injected at a wide angle. Owing to this arrangement, the sprayed pseudo hair increasing material and hair fixing liquid composition are favorably admixed in air, so that the adhered pseudo hair increasing material will come to be more intimate with the natural hair.

Since the pseudo hair increasing container 3, the aerosol container 4 and the aerosol container 12 are merely fixed within the case 11 by the fixing wall portions 14*a*, 14*b*, 14*c* and the fixing member 14*d*, even when any one of the pseudo hair increasing material, the first propellant gas for the pseudo hair increasing material, the hair fixing liquid composition and the second propellant gas is used up, it can easily be supplemented by replacing the specific container removed from the case 11.

Furthermore, in the spraying apparatus 10 according to this embodiment, the pseudo hair increasing storage container 3 is disposed at a backward location within the case 11 and the aerosol containers 4 and 12 are disposed in side by side relation ahead of the container 3. Accordingly, the portion for storing the aerosol containers 4 and 12 can be served as a grip portion in use. Since the spraying operation can be performed with the grip portion held by hand, operability at the spraying time is extremely good.

Moreover, since the apparatus for spraying pseudo hair increasing material according to this embodiment employs, as in the first embodiment, a pseudo hair increasing material storage container obtained by adhering a plurality of members together and then integrating thereof, the pseudo hair increasing material does not leak into the case 11 thereby keeping the interior of the case 11 from soiling, and injection can be made continuously and in a stable manner.

The apparatus for spraying pseudo hair increasing material according to the present invention should not be limited to the above embodiments but various changes can be made without departing from the scope of the present invention. For example, the spraying apparatus of the present invention may include, as shown in FIG. 5, a discharge amount adjustment mechanism for pseudo hair increasing material.

Figure 5:
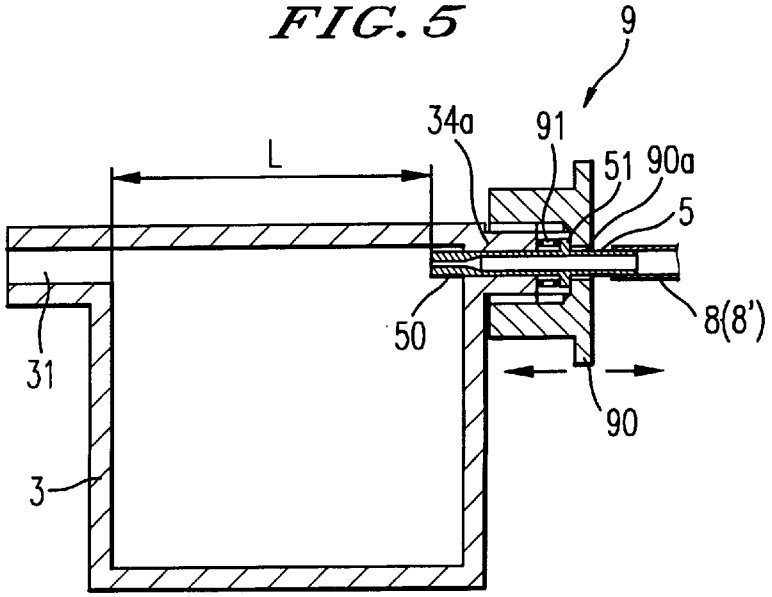
FIG. 5 is a sectional view showing an essential portion of another embodiment of an apparatus for spraying pseudo hair increasing material according to the present invention.

FIG. 5 is a sectional view showing a discharge amount adjustment mechanism for pseudo hair increasing material. This discharge amount adjustment mechanism 9 is an adjustment mechanism for adjusting the amount of the pseudo hair increasing material discharged from the discharge port 31 or injected through the discharge port 31, by varying the distance L between the discharge port 31 and the injection port 50 of the injection nozzle 5 for the pseudo hair increasing material in the first or second embodiment. The adjustment mechanism 9 includes an attachment port 34 disposed at the first container, an adjustment member 90 threadingly engaged with a projection 34*a* forming the attachment port 34 and capable of moving back and forth in accordance with rotation, an injection nozzle 5 capable of moving back and forth with a distal end portion thereof inserted in the attachment port 34 and a rear end portion thereof inserted in an insertion hole 90*a* formed in the adjustment member 90, and a coiled spring 91 for normally biasing the injection nozzle 5 towards the adjustment member 90 with one end portion thereof abutted with an annular projection 51 of the injection nozzle 5.

Figure 6A:
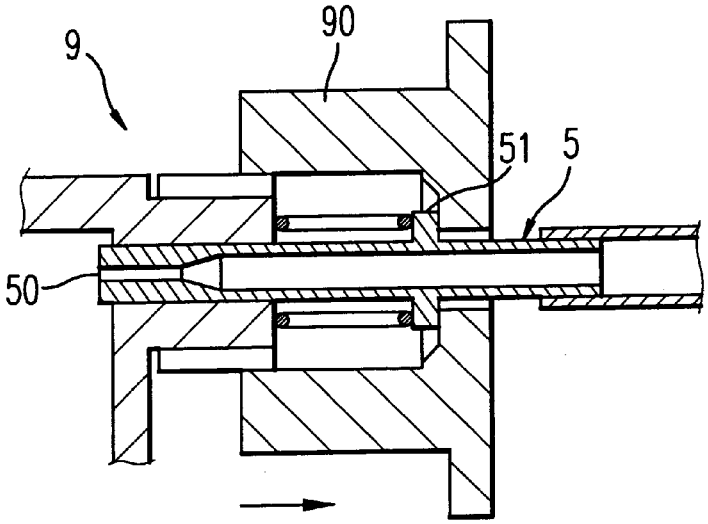
FIG. 6 shows a discharge amount adjustment mechanism of the apparatus for spraying pseudo hair increasing material of FIG. 5, FIG. 6(*a*) is a sectional view (discharge (injection): large in amount) and FIG. 6(*b*) is a sectional view (discharge (injection): small in amount)
Figure 6B:
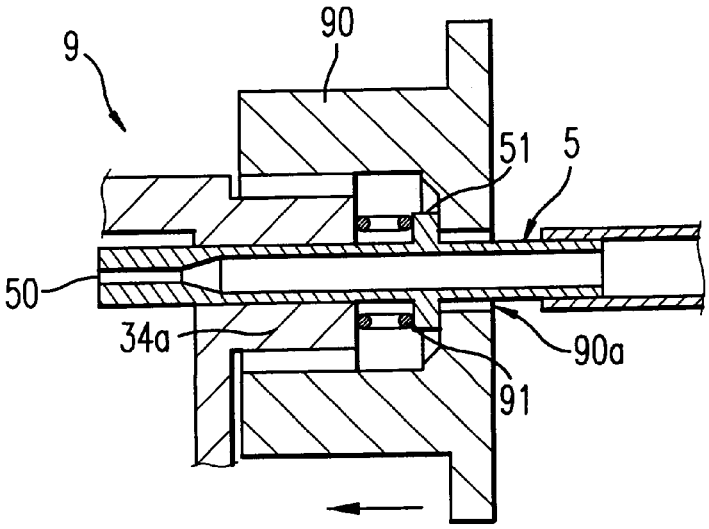

The discharge amount is adjusted by the discharge amount adjustment mechanism 9 in the following manner. That is, in case the discharge amount is to be increased, the adjustment member 90 is rotated in a direction for retracting the injection nozzle 5. When the injection nozzle 5 is retracted as shown in FIG. 6(*a*), the distance L between the injection port 50 at the distal end of the injection nozzle 5 and the discharge port 31 is increased and the amount of the pseudo hair increasing material drawn into the jet stream formed between the injection port 50 and the injection port 34 is increased. As a consequence, the amount of the pseudo hair increasing material discharged from the discharge port 34 is increased and the amount of the pseudo hair increasing material injected from the injection opening portion 15*b* is also increased.

In contrast, in case the discharge amount is to be decreased, the adjustment member 90 is rotated in the opposite direction to advance the injection nozzle 5. When the injection nozzle 5 is advanced as shown in FIG. 6(*b*), the distance L between the injection port 50 and the discharge port 31 is decreased and the amount of the pseudo hair increasing material drawn into the jet stream is decreased. As a consequence, the amount of the pseudo hair increasing material discharged from the discharge port 31 is decreased and the amount of the pseudo hair increasing material injected from the injection opening portion 15*b* is also decreased.

By virtue of a provision of the discharge amount adjustment mechanism 9 thus constructed, the amount of injection of the pseudo hair increasing material can be adjusted notwithstanding the extremely simple construction. That is, there is provided an apparatus for spraying pseudo hair increasing material, capable of performing an adjustment with a high degree of precision notwithstanding the simple construction without a need of a provision of a complicated gas supplying device, a special valve provided at the aerosol container and adapted to adjust the injection amount, etc.

Figure 7:
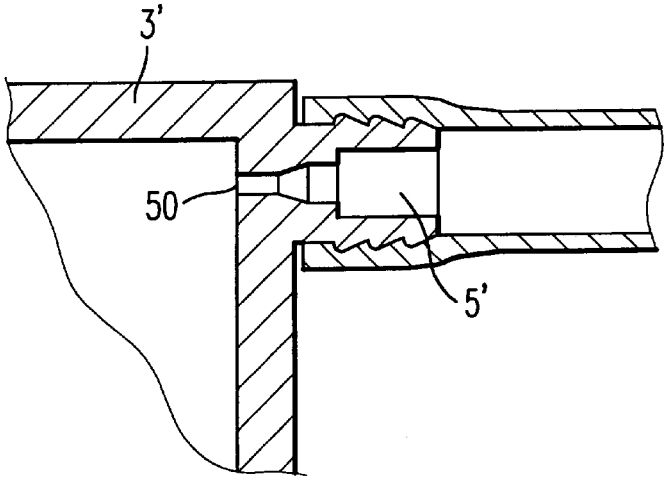
FIG. 7 is a sectional view showing an essential portion of still another embodiment of an apparatus for spraying pseudo hair increasing material according to the present invention.

In the apparatus for spraying pseudo hair increasing material according to the present invention, the injection nozzle 5 may be formed integrally with the first container in advance. In the apparatus for spraying pseudo hair increasing material according to the embodiment shown in FIG. 7, an injection nozzle 5' is integral with a first container 3'. Owing to this arrangement, the number of the component parts can be reduced to simplify the manufacturing management and to reduce the manufacturing cost.

In the apparatus for spraying pseudo hair increasing material according to the present invention, the first container for storing the pseudo hair increasing material is preferably, either wholly or partly, transparent or semitransparent, so that the remaining amount of the pseudo hair increasing material stored therein can easily be confirmed. Owing to this arrangement, the user feels at ease in using the apparatus while confirming the remaining amount. Moreover, the user can prepare for the case of shortage of the pseudo hair increasing material by, for example, storing a supplementing container in advance of the shortage.

In the present invention, as the propellant gas (first propellant gas) for injecting the pseudo hair increasing material, freon gas, substitute freon, liquid petroleum gas, dimethyl ether, and the like can be used.

Examples of the freon gas include trichloromonofluoromethane, dichlorodifluoromethane, dichlorotetrafluoroethane, trichlorotrifluoroethane and the like. Examples of the substitute freon gas include monochlorodifluoromethane, difluoroethane, trifluoroethane, tetrafluoroethane and the like. Examples of liquid petroleum gas include propane, n-butane, isobutane and the like. One or more of the propellant gas mentioned above can be used, but it is most preferable to solely use dimethylether because reduction in injection pressure during injection is small, while providing sufficient injection pressure in the temperature range of ordinary use.

In the present invention, the above-described propellant gas for injecting the pseudo hair increasing material can also be used as the propellant gas for injecting the liquid composition for fixing pseudo hair (i.e., the second propellant gas).

The pseudo hair increasing materials in a form of powder or short fiber used in the present invention include natural fiber such as human hair, wool, cotton and silk or regenerated fiber thereof and synthetic fiber or carbon fiber such as nylon, vinylon and polyester whose color are black or the like similar to human hair color or which can be dyed such color.

The average diameter of the pseudo hair increasing materials in a form of powder or short fiber preferably ranges from 5 to 120 $\mu$m under optical microscope observation and the length thereof preferably ranges from 10 to 2000 $\mu$m. In order to make the length uniform to fall within the above-mentioned range, a conventional cutting method such as a guillotine cutter, or a method of pulverizing with a pulverizer followed by sieving out is applicable. Making the length uniform is not essential and distribution in length is permissible as far as the length falls within the rang of 10 to 2000 $\mu$m.

In addition, for purpose of enhancing the scatter and separation property of the pseudo hair increasing materials, they can be treated with a conventional separation accelerator in accordance with material nature thereof.

Examples of the separation accelerator include inorganic salts such as sodium silicate, magnesium sulfate, sodium chloride, sodium sulfate and magnesium chloride; surfactants such as anionic surfactant, cationic surfactant and amphoteric surfactant; organic silicon compounds such as colloidal silica; and alminasol and the like.

The liquid composition for fixing pseudo hair to be injected together with the pseudo hair increasing materials is not particularly limited as far as it can be injected with the second propellant gas. Examples thereof include a composition for hair set spray, a hair growing and hair nourishing composition, a hair lotion composition, an adhesive, and the like.

Examples of the composition for hair set spray include ones containing, as a film-forming component, one or more of mixture of cationic polymer, nonionic polymer, anionic polymer and amphoteric polymer.

Examples of the cationic polymer include hydroxyethylcellulose hydroxypropyltrimethylammonium chloride ether (manufactured by UNION CARBIDE, under tradename "POLYMER-JR-400"), vinylpyrrolidone-N,N-dimethylaminoethylmethacrylate copolymer diethylsulfate salt (manufactured by ISP, under tradename "Gafquart 734") and the like.

Examples of the nonionic polymer include polyvinylpyrrolidone (manufactured by BASF, under tradename "Luviskol K Series"), polyvinylpyrrolidone/vinylacetate copolymer (manufactured by BASF, under tradename "Luviskol VA Series") and the like.

Examples of the anionic polymer include alkanolamine solution of acrylic resin (manufactured by GOO Chemical Co., under tradename: "Plascize L-53PB"), vinylacetate-crotonic acid copolymer (manufactured by HOECHST JAPAN, tradename: "ARISTFLEX A60") and the like.

Examples of amphoteric polymer include N-methacryloylethyl N,N'-dimethylammonium-α-N-methylcarboxybetaine-butylmethacrylate copolymer (manufactured by MITSUBISHI Chemical, under tradename "Yukaformer AM-75") and the like.

Examples of the composition for hair set spray include the following formulation examples.

Formulation Example 1 (hard type)

| | |
|---|---|
| alkanolamine solution of acrylic resin (30%) | 5.0 wt % |
| polyoxyethylene oleyl ether | 0.02 wt % |
| perfume | 0.17 wt % |
| ethanol | 49.81 wt % |
| LPG (propellant gas; 2.5 kg/cm$^2$) | 45.00 wt % |

Formulation Example 2 (soft type)

| | |
|---|---|
| Yukaformer AM-75 (30%) | 3.0 wt % |
| polyoxyethylene oleyl ether | 0.03 wt % |
| perfume | 0.17 wt % |
| ethanol | 51.80 wt % |
| LPG (propellant gas; 2.5 kg/cm$^2$) | 45.00 wt % |

The hair glowing and hair nourishing composition, which can be injected with the propellant gas, contains blood-flow facilitating components for peripheral blood vessel such as Vitamin E and its derivatives, Swertia herb extract, garlic extract, carrot extract, aloe extract, gentian extract, Rabdosiae herb, Angelica root extract, cepharathin, capronium chloride, and minoxidil; local stimulating components such as red pepper tincture, nonylic acid vanylamide, catharidis tincture, ginger tincture, peppermint oil, 1-menthol, camphor and nicotinate; ovarian hormon components such as estrone, estradiol and ethinylestradiol; metabolic activating components such as hinokitiol, pantothenylethylether, placenta extract, biotin and pentadecanoate glycerid; nutritive components such as Vitamines (A, $B_2$, $B_6$, $B_{12}$, D, etc.) and amino acids (cystein, serine, methionine, leucine, tryptophane, etc.); anti-inflammatory components such as components derived from glycyrrhetinic acid and glycyrrhiza extract, hydrochloric acid diphenhydramine, lithospermum root and the like; and keratine-soluble components, antiseborrhoeic components, bactericidal components and the like.

Specific examples of the hair glowing and hair nourishing composition include the following formulation examples.

Formulation Example 3

| | |
|---|---|
| dipotassium glycyrrhizinate | 0.1 wt % |
| dl-α-tocopherol acetate | 0.05 wt % |
| Swertia herb extract | 1.5 wt % |
| 1-menthol | 0.1 wt % |
| dipropylene glycol | 1.0 wt % |
| perfume | appropriate amount |
| ethanol | 50.0 wt % |
| purified water | balance |
| dimethylether (propellant gas) | 15.0 wt % |

Furthermore, the hair lotion composition contains hair lotion component of low viscosity such as hair liquid and can be injected in spraying by the propellant gas or the like. Examples thereof include the following formulation examples.

Formulation Example 4

| | |
|---|---|
| polyoxypropylenebutylether (40P.O.) | 10.0 wt % |
| ethanol | 30.0 wt % |
| perfume | appropriate amount |
| purified water | balance |
| dimethylether (propellant gas) | 45.0 wt % |

Examples of the adhesive include ones that contain, as the adhesive component, one or more of water-soluble substances such as polysaccharides or the derivatives thereof or polyvinyl alcohol and viscoelastic granules and that can be injected in spraying by the propellant gas or the like.

Examples of the polysaccharides and the derivatives thereof include natural starch, caroxymethyl cellulose, dextrine, chitin, amylose and the like.

Examples of the viscoelastic particles include natural rubber latex emulsion, emulsion of alkylacrylate-vinylacetate copolymer and the like.

Formulation Example 5

| | |
|---|---|
| carboxymethyl cellulose | 0.5 wt % |
| polyvinyl alcohol | 2.0 wt % |
| ethanol | 10.0 wt % |
| purified water | balance |
| dimethylether (propellant gas) | 30.0 wt % |

Formulation Example 6

| | |
|---|---|
| aqueous dispersion of lauric acrylate.vinyl acetate copoymer (20%) | 8.0 wt % |
| ethanol | 5.0 wt % |
| purified water | balance |
| dimethylether (propellant gas) | 50.0 wt % |

Figure 8:
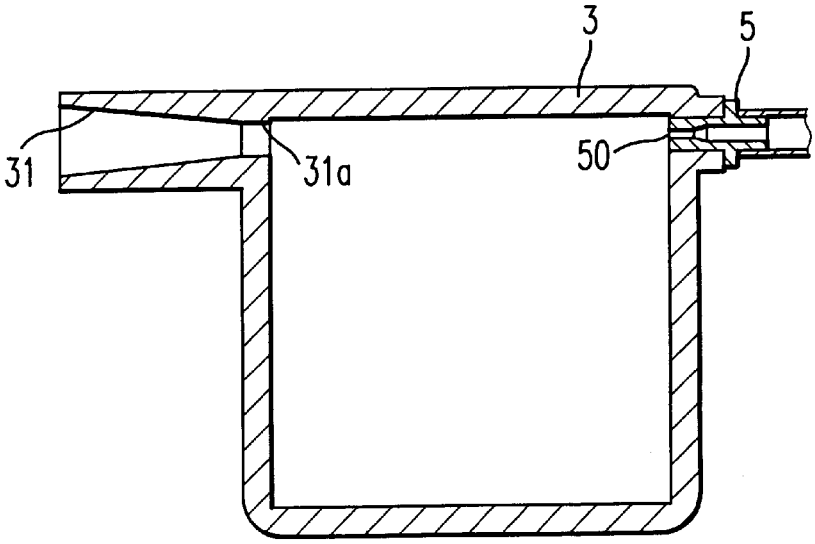
FIG. 8 is a sectional view showing an essential portion of yet another embodiment of an apparatus for spraying pseudo hair increasing material according to the present invention.

The apparatus for spraying pseudo hair increasing material according to the present invention is, by no means, limited to the above embodiments but various changes including dimension, configuration, etc. can be made in accordance with necessity, without departing from the scope of the present invention. For example, the discharge port 31 may be tapered as shown in FIG. 8.

INDUSTRIAL APPLICABILITY

According to the apparatus for spraying pseudo hair increasing material according to the present invention, the following effects can be exhibited.

According to the feature of the present invention as recited in claims 1 to 3, the pseudo hair increasing material in the form of powder or short fabrics can be sprayed to the area of the head where hair is locally decreased, continuously and in a stable manner. In case the pseudo hair increasing material or the first propellant gas is used up, it can very easily be supplemented without soiling the periphery by replacing the specific containers. By this, the pseudo hair increasing material or the propellant gas can efficiently be used without any waste and even in case the pseudo-hair increasing material becomes short while the spraying operation is undergoing, the spraying operation can be immediately started again by replacing the container. [0070]

According to the feature of the invention as recited in claims 4 to 6, by spraying the pseudo hair increasing material in the form of powder or short fabrics together with the hair fixing liquid composition, the pseudo hair increasing material can be sprayed continuously and in a stable manner and the adhesive force of the pseudo hair increasing material with respect to the natural hair or the scalp of the head can be enhanced. [0071]

According to the apparatus for spraying pseudo hair increasing material as recited in claim 2 or 5, in addition to the above-mentioned effects, the discharge amount of the pseudo hair increasing material can be adjusted without a need of enlarging the apparatus. Owing to this feature, the pseudo hair increasing material can be sprayed in accordance with the condition of the area of the head where the material is to be sprayed. For example, in case the area of the head where hair is decreased is large, the discharge amount of the pseudo hair increasing material is increased and the pseudo hair increasing material is sprayed from a location far from the head. On the other hand, in case the area is small, the discharge amount is decreased and the pseudo hair increasing material is sprayed from a location near the head.

What is claimed is:

1. An apparatus for spraying pseudo hair increasing material including a first container for storing therein pseudo hair increasing material in a form of powder or short fabrics, and a second container for storing therein propellant gas;

said first and second containers being detachably coupled to each other through a coupler;

said second container being provided therein with an injection mechanism for injecting said propellant gas into said first container through an injection nozzle, and wherein the second container is an aerosol container capable of injecting said propellant gas by pushing down on a nozzle member disposed on an upper portion thereof;

said first container being formed with a discharge port for discharging said pseudo hair increasing material therethrough, said discharge port having an axis in alignment with that of said injection nozzle, a bore of said discharge port being larger than that of an injection port formed on a distal end of said injection nozzle;

through operation of said injection mechanism, said propellant gas from said injection nozzle being injected to thereby cause said pseudo hair increasing material to be discharged from said discharge port towards a predetermined area, further including a discharge amount adjustment mechanism for adjusting an amount of said pseudo hair increasing material to be discharged from said discharge port by varying a distance between said discharge port for said pseudo hair increasing material and said injection port of said injection nozzle.

2. An apparatus for spraying pseudo hair increasing material according to claim 1, wherein said second container is a cylindrical member and said coupler comprises an annular member to be fixedly engaged with an upper part of said second container.

3. An apparatus for spraying pseudo hair increasing material including a first container for storing therein pseudo hair increasing material in a form of powder or short fabrics, a second container for storing therein a first propellant gas, a third container for storing therein a liquid composition for fixing pseudo hair and a second propellant gas, and an injection mechanism for injecting said first propellant gas into said first container through an injection nozzle and for injecting said hair fixing liquid composition towards a predetermined area by said second propellant gas;

said first container being formed with a discharge port for discharging said pseudo hair increasing material therethrough, said discharge port having an axis in alignment with that of said injection nozzle, a bore of said discharge port being larger than that of an injection port formed on a distal end of said injection nozzle;

through operation of said injection mechanism, said hair fixing liquid composition being injected towards a predetermined area and said pseudo hair increasing material being discharged towards said predetermined area by said first propellant gas injected from said injection nozzle, through said discharge port.

4. An apparatus for spraying pseudo hair increasing material according to claim 3, further including a discharge amount adjustment mechanism for adjusting an amount of said pseudo hair increasing material to be discharged through said discharge port by varying a distance between said discharge port for said pseudo hair increasing material and said injection port of said injection nozzle.

5. An apparatus for spraying pseudo hair increasing material according to claim 3 or 4, wherein said first, second and third containers are independently detachably stored in cases, respectively.

* * * * *